US009159193B2

(12) United States Patent
Walker et al.

(10) Patent No.: US 9,159,193 B2
(45) Date of Patent: Oct. 13, 2015

(54) METHOD AND APPARATUS FOR GAMING WITH ALTERNATE VALUE PAYOUTS

(71) Applicant: IGT, Las Vegas, NV (US)

(72) Inventors: Jay S. Walker, Ridgefield, CT (US); James A. Jorasch, New York, NY (US); Scott T. Friesen, New York, NY (US); Stephen C. Tulley, Fairfield, CT (US); Geoffrey M. Gelman, Brooklyn, NY (US); Dean P. Alderucci, Westport, CT (US)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 14/094,332

(22) Filed: Dec. 2, 2013

(65) Prior Publication Data

US 2014/0087852 A1 Mar. 27, 2014

Related U.S. Application Data

(63) Continuation of application No. 14/024,169, filed on Sep. 11, 2013, now Pat. No. 8,979,628, which is a continuation of application No. 13/485,279, filed on May 31, 2012, now Pat. No. 8,535,145, which is a (Continued)

(51) Int. Cl.
*A63F 9/24* (2006.01)
*G07F 17/32* (2006.01)

(52) U.S. Cl.
CPC ..... *G07F 17/3244* (2013.01); *G07F 17/32* (2013.01); *G07F 17/3248* (2013.01)

(58) Field of Classification Search
CPC ..... G07F 17/32
USPC ..... 463/16–20, 25–29
See application file for complete search history.

(56) References Cited

U.S. PATENT DOCUMENTS

| | | | |
|---|---|---|---|
| 4,636,951 | A | 1/1987 | Harlick |
| 4,722,554 | A | 2/1988 | Pettit |
| 4,764,666 | A | 8/1988 | Bergeron |
| 4,815,741 | A | 3/1989 | Small |
| 4,837,728 | A | 6/1989 | Barrie et al. |
| 4,882,473 | A | 11/1989 | Bergeron et al. |
| 5,038,022 | A | 8/1991 | Lucero |

(Continued)

FOREIGN PATENT DOCUMENTS

| | | |
|---|---|---|
| GB | 2 096 376 | 10/1982 |
| GB | 2 142 457 | 1/1985 |

(Continued)

OTHER PUBLICATIONS

U.S. Examiner's office Action dated Mar. 21, 2005, U.S. Appl. No. 10/156,576, filed May 24, 2002 22 pgs.

(Continued)

*Primary Examiner* — Omkar Deodhar
(74) *Attorney, Agent, or Firm* — Neal, Gerber & Eisenberg LLP

(57) ABSTRACT

Systems and methods are provided for permitting a player to play a game at a gaming device. The gaming device provides a payout for the game. The payout is redeemable for one of a plurality of values, and at least two of the plurality of values are different from each other. The values typically have different corresponding forms of payout, such as cash or merchandise credits.

17 Claims, 16 Drawing Sheets

Related U.S. Application Data continuation of application No. 11/422,436, filed on Jun. 6, 2006, now Pat. No. 8,192,276, which is a continuation of application No. 10/156,576, filed on May 24, 2002, now abandoned.

(60) Provisional application No. 60/293,400, filed on May 24, 2001.

(56) References Cited

U.S. PATENT DOCUMENTS

| | | | |
|---|---|---|---|
| 5,135,224 | A | 8/1992 | Yamamoto et al. |
| 5,159,549 | A | 10/1992 | Hallman, Jr. et al. |
| 5,179,517 | A | 1/1993 | Sarbin et al. |
| 5,275,400 | A | 1/1994 | Weingardt et al. |
| 5,342,047 | A | 8/1994 | Heidel et al. |
| 5,371,345 | A | 12/1994 | LeStrange et al. |
| 5,377,973 | A | 1/1995 | Jones et al. |
| 5,397,125 | A | 3/1995 | Adams |
| 5,429,361 | A | 7/1995 | Raven et al. |
| 5,470,079 | A | 11/1995 | LeStrange et al. |
| 5,511,781 | A | 4/1996 | Wood et al. |
| 5,546,523 | A | 8/1996 | Gatto |
| 5,559,312 | A | 9/1996 | Lucero |
| 5,564,700 | A | 10/1996 | Celona |
| 5,575,717 | A | 11/1996 | Houriet, Jr. et al. |
| 5,639,088 | A | 6/1997 | Schneider et al. |
| 5,674,128 | A | 10/1997 | Holch et al. |
| 5,708,782 | A | 1/1998 | Larson et al. |
| 5,752,239 | A | 5/1998 | Coutts |
| 5,766,074 | A | 6/1998 | Cannon et al. |
| 5,770,533 | A | 6/1998 | Franchi |
| 5,816,918 | A | 10/1998 | Kelly et al. |
| 5,905,246 | A | 5/1999 | Fajkowski |
| 5,919,091 | A | 7/1999 | Bell et al. |
| 5,951,397 | A | 9/1999 | Dickinson |
| 5,984,779 | A | 11/1999 | Bridgeman et al. |
| 5,993,316 | A | 11/1999 | Coyle et al. |
| 6,014,594 | A | 1/2000 | Heidel et al. |
| 6,015,344 | A | 1/2000 | Kelly et al. |
| 6,048,269 | A | 4/2000 | Burns et al. |
| 6,056,289 | A | 5/2000 | Clapper, Jr. |
| 6,056,642 | A | 5/2000 | Bennett |
| 6,068,552 | A | 5/2000 | Walker et al. |
| 6,110,044 | A | 8/2000 | Stern |
| 6,113,098 | A | 9/2000 | Adams |
| 6,125,307 | A | 9/2000 | Heidel et al. |
| 6,128,550 | A | 10/2000 | Heidel et al. |
| 6,139,419 | A | 10/2000 | Abe |
| 6,151,587 | A | 11/2000 | Matthias |
| 6,168,522 | B1 | 1/2001 | Walker et al. |
| 6,193,608 | B1 | 2/2001 | Walker et al. |
| 6,266,647 | B1 | 7/2001 | Fernandez |
| 6,293,866 | B1 | 9/2001 | Walker et al. |
| 6,332,099 | B1 | 12/2001 | Heidel et al. |
| 6,375,187 | B1 | 4/2002 | Baerlocher |
| 6,450,887 | B1 | 9/2002 | Mir et al. |
| 6,500,067 | B1 | 12/2002 | Luciano et al. |
| 6,500,068 | B2 | 12/2002 | Walker et al. |
| 6,511,377 | B1 | 1/2003 | Weiss |
| 6,530,842 | B1 | 3/2003 | Wells et al. |
| 6,537,151 | B1 | 3/2003 | Walker et al. |
| 6,558,255 | B2 | 5/2003 | Walker et al. |
| 6,558,256 | B1 | 5/2003 | Saunders |
| 6,599,192 | B1 | 7/2003 | Baerlocher et al. |
| 6,609,970 | B1 | 8/2003 | Luciano, Jr. |
| 6,620,047 | B1 | 9/2003 | Alcorn et al. |
| 6,648,754 | B2 | 11/2003 | Baerlocher et al. |
| 6,743,097 | B2 | 6/2004 | Walker et al. |
| 6,835,134 | B2 | 12/2004 | Poole et al. |
| 6,843,720 | B2 | 1/2005 | Luciano et al. |
| 6,857,959 | B1 | 2/2005 | Nguyen |
| 7,001,277 | B2 | 2/2006 | Walker et al. |
| 7,006,983 | B1 | 2/2006 | Packes et al. |
| 2003/0092477 | A1 | 5/2003 | Luciano et al. |
| 2003/0209599 | A1 | 11/2003 | Gatto |

FOREIGN PATENT DOCUMENTS

| | | |
|---|---|---|
| GB | 2 161 008 | 1/1986 |
| GB | 2 161 009 | 1/1986 |
| GB | 2 181 589 | 4/1987 |
| GB | 2 183 882 | 6/1987 |
| GB | 2 222 712 | 3/1990 |
| WO | WO 85/00910 | 2/1985 |

OTHER PUBLICATIONS

U.S. Examiner's office Action dated Nov. 13, 2006, U.S. Appl. No. 10/156,576, filed May 24, 2002 6 pgs.

U.S. Examiner's office Action dated Apr. 13, 2007, U.S. Appl. No. 10/156,576, filed May 24, 2002 8 pgs.

U.S. Examiner's office Action dated Jan. 24, 2007, U.S. Appl. No. 11/422,453, filed Jun. 6, 2006 18 pgs.

U.S. Examiner's Office Action dated Jun. 19, 2007, U.S. Appl. No. 11/422,453, filed Jun. 6, 2006 9 pgs.

U.S. Examiner's office Action dated Jan. 24, 2007, U.S. Appl. No. 11/422,464, filed Jun. 6, 2006 18 pgs.

U.S. Examiner's Office Action dated Jun. 7, 2007, U.S. Appl. No. 11/422,464, filed Jun. 6, 2006 13 pgs.

U.S. Examiner's office Action dated Jun. 18, 2007, U.S. Appl. No. 11/422,464, filed Jun. 6, 2006 9 pgs.

U.S. Examiner's office Action dated Sep. 17, 2007, U.S. Appl. No. 10/156,576, filed May 24, 2002 8 pgs.

"Slot machine maker taking a chance with cashless slots system", Las Vegas SUN, Jan. 27, 2001, (http //www lasvegassun com/sunbin/stories/gaming/2001/jan/27/511355621 html), 2 pp.

Stearns, John, "SPAM, Beetle Bailey among new slot titles to be unveiled by IGT", Reno Gazette-Journal, Sep. 28, 2001, Section: Business, 5 pp.

"JCM Receives Suppliers License in Illinois", PR Newswire, Dec. 9, 2002, Section: Financial news 5 pp.

Website: "Company Profile", JCM American Corporation (http //www jcm-american com/docs/cs_Company%20Profile pdf), download date: Jun. 11, 2003, 8 pp.

Website: "Fiesta Casino Hotel Plans to Put EZ Pay to the Test", IGT, (http //www igtonline com/info/images/SLwntr00_Ezpay_3.0 pdf), download date: Jun. 11, 2003, 1 pg.

Website: "Market Mania—Message Detail", Market Manipulators, (http www marketmanipulators com/msgdetail asp?msgid=820 &msgboard=DAY-TRADING), download date: Aug. 4, 2006, 3 pp.

Website "Position Statement—Request Prize Zone Machine", Colorado Deparatment of Revenue, (http //www revue state co us/liquor_dir/op6 htm), download date: Aug. 4, 2006, 5 pp.

600

| PAYOUT IDENTIFIER 602 | CASH VALUE 604 | OFFER IDENTIFIER 606 | PIN 608 | PLAYER TRACKING NUMBER 610 |
|---|---|---|---|---|
| T25652 | $80 | OF361 | 1123 | PT112132 |
| T36565 | $1,100 | OF375 | 6689 | PT565559 |
| T12379 | $150 | OF557 | 7516 | PT829778 |

FIG. 6

700

| PLAYER IDENTIFIER 702 | NAME 704 | FINANCIAL ACCOUNT IDENTIFIER 706 | DEMOGRAPHIC 708 | MACHINE IDENTIFIER(S) 710 |
|---|---|---|---|---|
| 111123P | SAM BROWN | 1111-1111-1111-1111 | MALE, AGE 23 | M234, M001 |
| 222234P | LINDA JONES | 2222-2222-2222-2222 | FEMALE, AGE 47 | M532 |

| RATE OF PLAY 712 | TOTAL DURATION OF PLAY 714 | PROJECTED THEORETICAL WIN 716 | HISTORICAL THEORETICAL WIN 718 | CASINO ACTUAL WIN/LOSS 720 |
|---|---|---|---|---|
| 6 PLAYS/MIN. | 1:06 | $58 | $252 | $26 |
| 10 PLAYS/MIN. | 2:38 | $53 | $105 | $44 |

FIG. 7

800

| OFFER IDENTIFIER 802 | CASH 804 | CASINO STORE 806 | CASINO SPA 808 | CASINO RESTAURANT 810 | AMAZON.COM™ 812 | SOFTWARE STORE 814 | WALMART™ 816 |
|---|---|---|---|---|---|---|---|
| T3619 | 1X | 1.2X | 1.2X | 1.2X | 1.3X | 2.5X | 2.5X |
| T3757 | 1X | 1.1X | 1.2X | 1.2X | 1.0X | 2.3X | 2.5X |
| T3574 | 1X | 1.2X | 1.2X | 1.2X | 1.0X | 1.0X | 2.5X |

FIG. 8

METHOD AND APPARATUS FOR GAMING WITH ALTERNATE VALUE PAYOUTS

PRIORITY CLAIM

This application is a continuation of, claims priority to and the benefit of U.S. patent application Ser. No. 14/024,169, filed on Sep. 11, 2013, which is a continuation of, claims priority to and the benefit of U.S. patent application Ser. No. 13/485,279, filed on May 31, 2012, which is a continuation of, claims priority to and the benefit of U.S. patent application Ser. No. 11/422,436, filed on Jun. 6, 2006, now U.S. Pat. No. 8,192,276, which is a continuation of, claims priority to and the benefit of U.S. patent application Ser. No. 10/156,576, filed on May 24, 2002, now abandoned, which claims priority to and the benefit of U.S. Provisional Patent Application No. 60/293,400, filed on May 24, 2001, the entire contents of which are each incorporated by reference herein.

FIELD OF THE INVENTION

The present invention relates to game playing apparatus and methods.

BACKGROUND OF THE INVENTION

Game playing may be based on skill and/or based on chance. In games of chance, a player places a wager on one or more games and may receive a payout based on the outcome of the game and/or the wager. Games of chance may occur through various devices or may be conducted without a device. Examples of devices for games of chance include without limitation video poker, video black jack, mechanical slot machines and video slot machines.

Typically, payout from games of chance is in the form of bills, coins, tokens or vouchers printed on paper tickets. Such vouchers (also known as "cashless gaming tickets") include indicia such as a bar code, and the bar code indicates, among other things, the value of the payout (e.g., $10). The voucher may be inserted into a gaming device and the gaming device reads the bar code. Thus the voucher may be used to place one or more wagers. Such vouchers may also be redeemed for cash by exchanging the voucher at, e.g., a cashier's window.

Payout from skill-based games may also be made in a variety of forms known in the art.

BRIEF DESCRIPTION OF THE DRAWINGS

FIG. 6 is a tabular representation of an embodiment of a payout database.

FIG. 7 is a tabular representation of an embodiment of a player database.

FIG. 8 is a tabular representation of an embodiment of an offer database.

DETAILED DESCRIPTION OF THE INVENTION

Applicants have recognized that many different types of players would find it appealing to choose a form of payout for a game.

Applicants have also recognized that many different types of players would find it appealing to have a payout with an increased value.

Applicants have also recognized that many different types parties would benefit in various ways from participating in the payout to a player.

System

Figure 1:
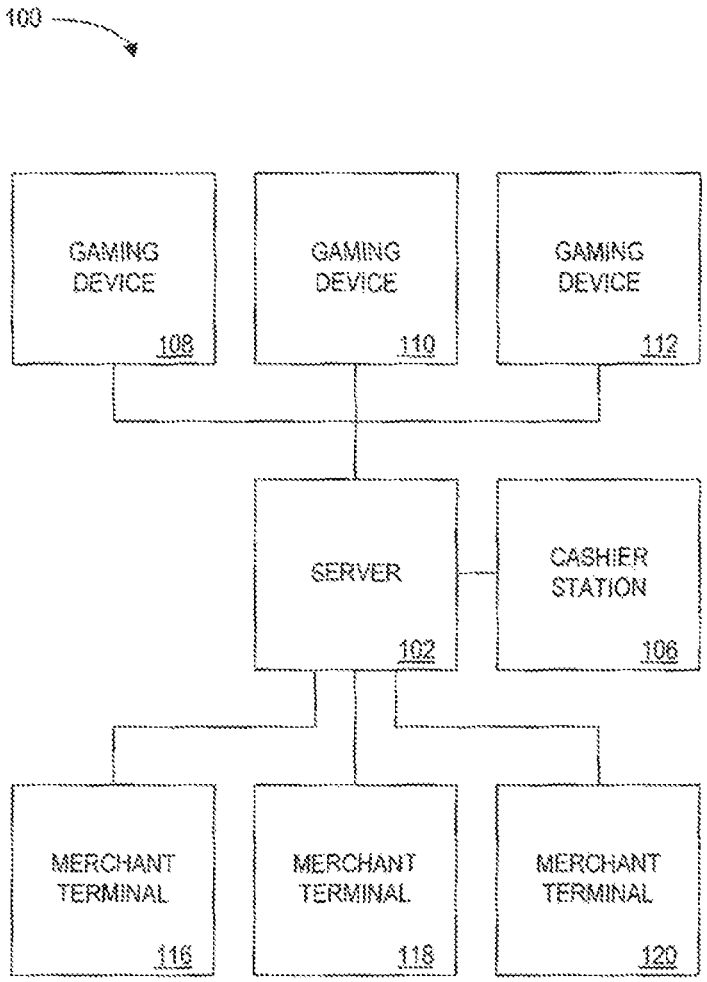
FIG. 1 is a block diagram of an embodiment of the present invention.

Referring now to FIG. 1, an apparatus 100 according to embodiments of the present invention includes a server 102 server 102 that is in communication with a cashier station 106, gaming devices 108, 110 and 112, and merchant terminals 116, 118 and 120. Each of the gaming devices, cashier station and merchant terminals may comprise computers, such as those based on the Intel® Pentium® processor, that are adapted to communicate with the server 102; portable types of computers, such as a laptop computer; a palm-top computer; a hand-held computer; or a Personal Digital Assistant (FDA). Other equivalent devices capable of performing the methods specified herein are well known in the art.

Any number of gaming devices, cashier station and merchant terminals may be in communication with the server 102. The number of each depicted in FIG. 1 is solely for purposes of illustration The server 102 may communicate with the gaming devices, the cashier station and the merchant terminals directly or via a network, including without limitation the Internet, wireless network protocol, local area network or a combination thereof, through a Web site maintained by server 102 on a remote server or over an on-line data network including commercial on-line service providers, and bulletin board systems. The server may communicate with the gaming devices, the cashier station and the merchant terminals directly or indirectly. In yet other embodiments, the devices may communicate with server 102 over RF, cable TV, satellite links and the like.

Those skilled in the art will understand that devices in communication with each other need not be continually transmitting to each other. On the contrary, such devices need only transmit to each other as necessary, and may actually refrain from exchanging data most of the time. For example, a device in communication with another device via the Internet may not transmit data to the other device for weeks at a time.

The server 102 may function as a "Web server" that generates Web pages (documents on the Web that typically include an HTML file and associated graphics and script files) that may be accessed via the Web and allows communication with the server 102 in a manner known in the art.

FIG. 1 depicts only an embodiment of the invention. Other arrangements of devices to perform various methods specified herein will be readily appreciated by those of skill in the art.

Devices

Figure 2:
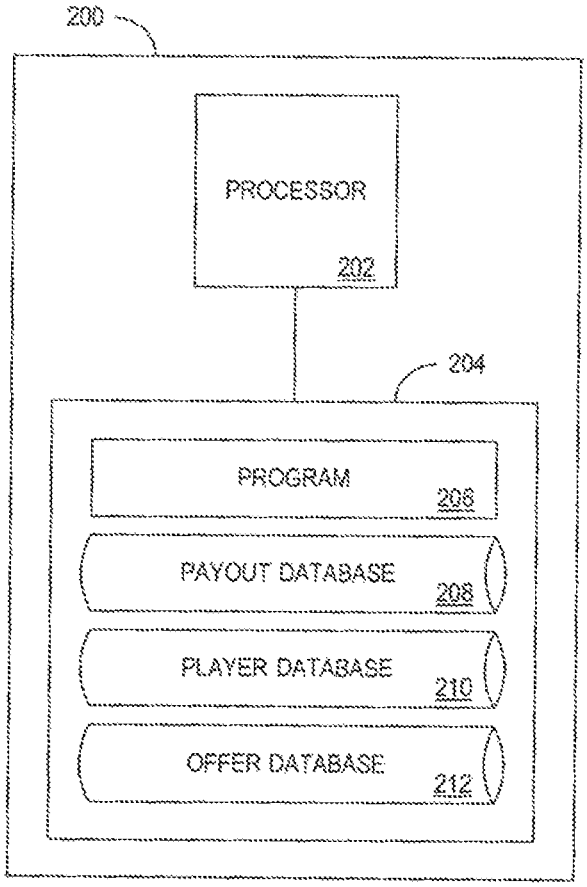
FIG. 2 is a block diagram of a server of one embodiment.

FIG. 2 illustrates an embodiment 200 of the server 102. The server 102 may be implemented as a system controller, a dedicated hardware circuit, an appropriately programmed general-purpose computer, or any other appropriate device including without limitation electronic, mechanical or electromechanical devices.

The server of the illustrated embodiment comprises a processor 201, such as one or more Intel® Pentium® microprocessors. The processor 201 is in communication with a data storage device 204. The data storage device 204 comprises magnetic memory, optical memory, semiconductor memory or any combination thereof. The data storage device 204 may include, for example, Random Access Memory (RAM), Read-Only Memory (ROM), a compact disc and/or a hard disk. The processor 201 and the storage device 204 may each be, for example: (i) located entirely within a single computer or computing device; or (ii) connected to each other by a remote communication medium, including without limitation a serial port cable, a telephone line, a network connection or a radio frequency transceiver. In some embodiments, the server 102 may comprise one or more computers that are connected to a remote server computer for maintaining databases.

The data storage device 204 stores a program 206 for controlling the processor 201. The processor 201 performs instructions of the program 206, and thereby operates in accordance with the present invention, and particularly in accordance with the methods described in detail herein. The program 206 may be stored in a compressed, uncompiled and/or encrypted format, as well as in a variety of other forms known in the art. The program 206 furthermore includes program elements that may be necessary, including without limitation an operating system, a database management system and "device drivers" for allowing the processor 201 to interface with peripheral devices. Appropriate program elements are well known to those skilled in the art, and need not be described in detail herein.

According to an embodiment of the present invention, the instructions of the program 206 may be read into a main memory from another computer-readable medium, such as into RAM from hard drive or ROM. Execution of sequences of the instructions in program 206 causes processor 201 to perform process steps described herein. In alternative embodiments, hard-wired circuitry may be used in place of, or in combination with, software instructions for implementation of the processes of the present invention, as would be understood by those of skill in the art. Thus, embodiments of the present invention are not limited to hardware, software or any specific combination of hardware and software.

The storage device 204 also stores (i) a payout database 208, (ii) a player database 210, and (iii) an offer database 212. The databases are described in detail below and depicted with exemplary entries in the accompanying figures. As will be understood by those skilled in the art, the schematic illustrations and accompanying descriptions of the databases presented herein are exemplary arrangements for stored representations of information. A number of other arrangements may be employed besides those suggested by the tables shown. Similarly, the illustrated entries of the databases represent exemplary information only; those skilled in the art will understand that the number and content of the entries can be different from those illustrated herein. Based on the present disclosure many other arrangements of data will be readily understood by those of skill in the art.

Figure 3:
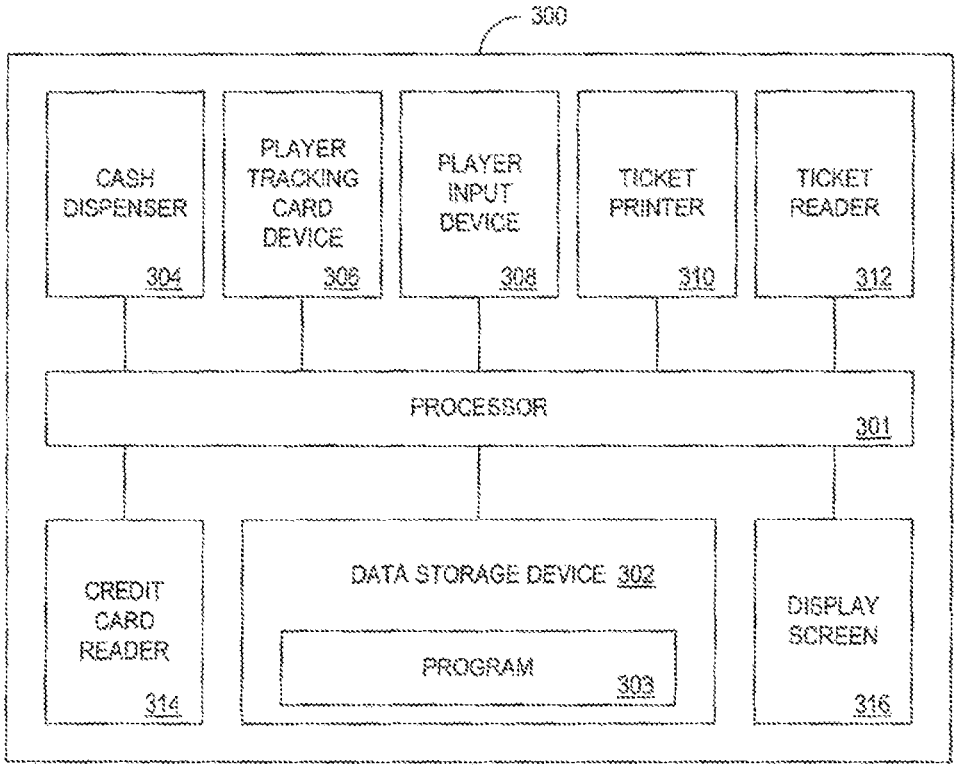
FIG. 3 is a block diagram of a gaming device of one embodiment.

FIG. 3 illustrates an embodiment 300 of a gaming device. Well-known examples of gaming devices include video poker, video black jack, mechanical slot machines and video slot machines. The gaming device may be implemented as a dedicated hardware circuit, an appropriately programmed general-purpose computer, or any other appropriate device including without limitation electronic, mechanical or electromechanical devices. Accordingly, the gaming device need not include the various components depicted in FIG. 3.

The gaming device of the illustrated embodiment comprises a processor 301 such as one or more Intel® Pentium® microprocessors. The processor 301 is in communication with a data storage device 302. The data storage device 302 comprises magnetic memory, optical memory, semiconductor memory or any combination thereof. The data storage device 302 may include, for example, Random Access Memory (RAM), Read-Only Memory (ROM), a compact disc and/or a hard disk. The processor 301 and the storage device 302 may each be, for example: (i) located entirely within a single computer or computing device; or (ii) connected to each other by a remote communication medium, including without limitation a serial port cable, a telephone line, a network connection or a radio frequency transceiver. In some embodiments, the gaming device may comprise one or more computers that are connected to a remote server computer for maintaining databases.

The data storage device 302 stores a program 303 for controlling the processor 301. The processor 301 performs instructions of the program 303, and thereby operates in accordance with the present invention, and particularly in accordance with the methods described in detail herein. The program 303 may be stored in a compressed, uncompiled and/or encrypted format, as well as in a variety of other forms known in the art. The program 303 furthermore includes program elements that may be necessary, including without limitation an operating system, a database management system and "device drivers" for allowing the processor 301 to interface with peripheral devices. Appropriate program elements are well known to those skilled in the art, and need not be described in detail herein.

According to an embodiment of the present invention, the instructions of the program 303 may be read into a main memory from another computer-readable medium, such as into RAM from hard drive or ROM. Execution of sequences of the instructions in program 303 causes processor 301 to perform process steps described herein. In alternative embodiments, hard-wired circuitry may be used in place of, or in combination with, software instructions for implementation of the processes of the present invention, as would be understood by those of skill in the art. Thus, embodiments of the present invention are not limited to hardware, software or any specific combination of hardware and software.

The processor 301 may also be in communication with a cash dispenser 304, which dispenses coins and/or bills to players that have requested to have funds be dispensed.

The processor 301 may also be in communication with a player tracking card device 306, which performs functions related to player tracking cards, such as reading player tracking cards and communicating information read from such cards to the processor 301. Typically, information read from such cards includes unique player identifiers, such as a sequence of digits or a sequence of alphanumeric characters.

The processor 301 may also be in communication with a player input device 308, which receives input from the player. Input device 308 may comprise a variety of devices, including without limitation one or more buttons, one or more touch screens, one or more handles or any combination of the above.

The processor 301 may also be in communication with a ticket printer 310, which may be commanded to print onto a substrate, such as paper or other material. Printing may be via ink jet, laser printing or other methodology for registering indicia on a substrate. Alternatively, the ticket may be registered with indicia by deforming the substrate in a variety of ways known in the art, including without limitation punching holes in the substrate and raising or lowering portions of the substrate relative to other portions.

The processor 301 may also be in communication with a ticket reader 312, which is capable of reading tickets and particularly indicia registered on tickets. The ticket reader 312 may use optical sensing of printed indicia, for example, and optical character recognition to read indicia from a ticket inserted in the ticket reader 312.

The processor 301 may also be in communication with a credit card reader 314. Such devices are known in the art, and generally allow a card such as a credit card or debit card to be inserted therewithin. The card may include a magnetic stripe or other form of data storage, which the credit card reader 314 is capable of sensing and interpreting. Typically, the credit card reader allows a credit card transaction to be processed by communication with a credit card clearinghouse in a manner known in the art.

The processor 301 may also be in communication with a display screen 316, which displays images in a manner known in the art. Typical display screens include, liquid crystal displays, plasma displays and video display monitors.

Figure 4:
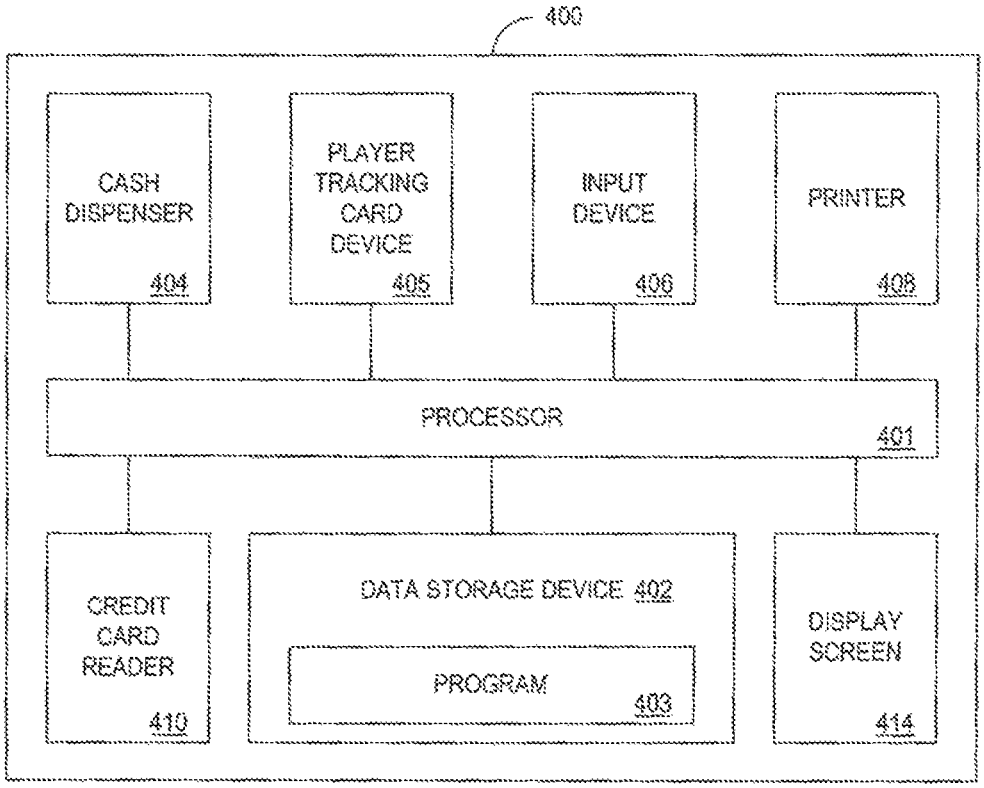
FIG. 4 is a block diagram of a merchant terminal of one embodiment.

FIG. 4 illustrates an embodiment 400 of a merchant terminal. The merchant terminal may be implemented as a dedicated hardware circuit, an appropriately programmed general-purpose computer, or any other appropriate device including without limitation electronic, mechanical or electromechanical devices.

The merchant terminal of the illustrated embodiment comprises a processor 401, such as one or more Intel® Pentium® microprocessors. The processor 401 is in communication with a data storage device 402. The data storage device 402 comprises magnetic memory, optical memory, semiconductor memory or any combination thereof. The data storage device 402 may include, for example, Random Access Memory (RAM), Read-Only Memory (ROM), a compact disc and/or a hard disk. The processor 401 and the storage device 402 may each be, for example: (i) located entirely within a single computer or computing device; or (ii) connected to each other by a remote communication medium, including without limitation a serial port cable, a telephone line, a network connection or a radio frequency transceiver. In some embodiments, the merchant terminal may comprise one or more computers that are connected to a remote server computer for maintaining databases.

The data storage device 402 stores a program 403 for controlling the processor 401. The processor 401 performs instructions of the program 403, and thereby operates in accordance with the present invention, and particularly in accordance with the methods described in detail herein. The program 403 may be stored in a compressed, uncompiled and/or encrypted format, as well as in a variety of other forms known in the art. The program 403 furthermore includes program elements that may be necessary, including without limitation an operating system, a database management system and "device drivers" for allowing the processor 401 to interface with peripheral devices. Appropriate program elements are well known to those skilled in the art, and need not be described in detail herein.

According to an embodiment of the present invention, the instructions of the program 403 may be read into a main memory from another computer-readable medium, such as into RAM from hard drive or ROM. Execution of sequences of the instructions in program 403 causes processor 401 to perform process steps described herein. In alternative embodiments, hard-wired circuitry may be used in place of, or in combination with, software instructions for implementation of the processes of the present invention, as would be understood by those of skill in the art. Thus, embodiments of the present invention are not limited to hardware, software or any specific combination of hardware and software.

The processor 401 may also be in communication with a cash dispenser 404, which dispenses coins and/or bills to people that have requested to have funds be dispensed. The cash dispenser 404 may alternatively be a cash drawer that may be automatically opened upon command from the processor 401.

The processor 401 may also be in communication with a player tracking card device 405, which performs functions related to player tracking cards, such as reading player tracking cards and communicating information read from such cards to the processor 401.

The processor 401 may also be in communication with a player input device 406, which receives input from a cashier, customer or an operator of the merchant terminal. Input device 406 may comprise a variety of devices, including without limitation one or more buttons, one or more touch screens, or any combination of the above.

The processor 401 may also be in communication with a printer 408, which may be commanded to print onto a substrate, such as paper or other material. Printing may be via ink jet, laser printing or other methodology for registering indicia on a substrate. Alternatively, the ticket may be registered with indicia by deforming the substrate in a variety of ways known in the art, including without limitation punching holes in the substrate and raising or lowering portions of the substrate relative to other portions. The printer 408 may be used for printing, e.g., receipts.

The processor 401 may also be in communication with a credit card reader 410. Such devices are known in the art, and generally allow a card such as a credit card or debit card to be inserted therewithin.

The processor 401 may also be in communication with a display screen 414, which displays images in a manner known in the art.

Figure 5:
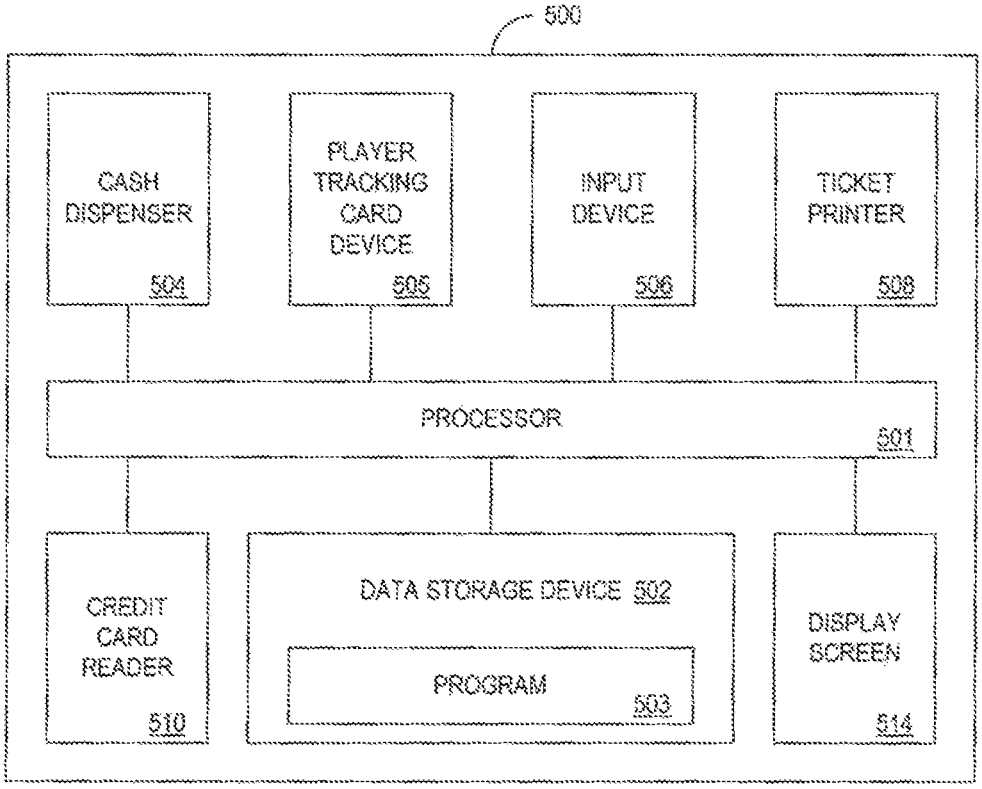
FIG. 5 is a block diagram of a cashier station of one embodiment.

FIG. 5 illustrates an embodiment 500 of a cashier station. The cashier station may be implemented as a dedicated hardware circuit, an appropriately programmed general-purpose computer, or any other appropriate device including without limitation electronic, mechanical or electromechanical devices.

The cashier station of the illustrated embodiment comprises a processor 501 such as one or more Intel® Pentium® microprocessors. The processor 501 is in communication with a data storage device 502. The data storage device 502 comprises magnetic memory, optical memory, semiconductor memory or any combination thereof. The data storage device 502 may include, for example, Random Access Memory (RAM), Read-Only Memory (ROM), a compact disc and/or a hard disk. The processor 501 and the storage device 502 may each be, for example: (i) located entirely within a single computer or computing device; or (ii) connected to each other by a remote communication medium, including without limitation a serial port cable, a telephone line, a network connection or a radio frequency transceiver. In some embodiments, the cashier station may comprise one or more computers that are connected to a remote server computer for maintaining databases.

The data storage device 502 stores a program 503 for controlling the processor 501. The processor 501 performs instructions of the program 503, and thereby operates in accordance with the present invention, and particularly in accordance with the methods described in detail herein. The program 503 may be stored in a compressed, uncompiled and/or encrypted format, as well as in a variety of other forms known in the art. The program 503 furthermore includes program elements that may be necessary, including without limitation an operating system, a database management system and "device drivers" for allowing the processor 501 to interface with peripheral devices. Appropriate program elements are well known to those skilled in the art, and need not be described in detail herein.

According to an embodiment of the present invention, the instructions of the program 503 may be read into a main memory from another computer-readable medium, such as into RAM from hard drive or ROM. Execution of sequences of the instructions in program 503 causes processor 501 to perform process steps described herein. In alternative embodiments, hard-wired circuitry may be used in place of, or in combination with, software instructions for implementation of the processes of the present invention, as would be understood by those of skill in the art. Thus, embodiments of the present invention are not limited to hardware, software or any specific combination of hardware and software.

The processor 501 may also be in communication with a cash dispenser 504, which dispenses coins and/or bills to people that have requested to have funds be dispensed. The cash dispenser 504 may alternatively be a cash drawer that may be automatically opened upon command from the processor 501.

The processor 501 may also be in communication with a player tracking card device 505, which performs functions related to player tracking cards, such as reading player tracking cards and communicating information read from such cards to the processor 501.

The processor 501 may also be in communication with a player input device 506, which receives input from a cashier, customer or an operator of the cashier station. Input device 506 may comprise a variety of devices, including without limitation one or more buttons, one or more touch screens, or any combination of the above.

The processor 501 may also be in communication with a printer 508, which may be commanded to print onto a substrate, such as paper or other material. Printing may be via ink jet, laser printing or other methodology for registering indicia on a substrate. Alternatively, the ticket may be registered with indicia by deforming the substrate in a variety of ways known in the art, including without limitation punching holes in the substrate and raising or lowering portions of the substrate relative to other portions. The printer 508 may be used for printing, e.g., receipts.

The processor 501 may also be in communication with a credit card reader 510. Such devices are known in the art, and generally allow a card such as a credit card or debit card to be inserted therewithin.

The processor 501 may also be in communication with a display screen 514, which displays images in a manner known in the art.

Databases

Payout Database

FIG. 6 is a tabular representation 600 of the payout database 208 of FIG. 2. The tabular representation 600 of the payout database 208 includes a number of example records or entries each defining a payout. Those skilled in the art will understand that the payout database 208 may include any number of entries. The tabular representation 600 also defines fields for each of the entries or records. The fields specify: (i) a payout identifier 602 that uniquely identifies the payout; (ii) a cash value 604 that indicates the value if the payout is redeemed for cash; (iii) an offer identifier 606 that indicates an offer that was accepted as part of the payout; (iv) a PIN code r other code that is used for authentication or security purposes; and (v) a player tracking number that uniquely identifies the player that owns or is otherwise associated with the payout.

Not all of the fields depicted in FIG. 6 are required, and various substitutions, deletions and other changes to the tabular representation will be readily apparent to those of ordinary skill in the art. For example, in another embodiment the cash value field 604 and the offer identifier field 606 may be replaced with an indication of a plurality of values and corresponding forms of payout. As another example, the PIN code is not needed in many embodiments. As another example, the player tracking number is not needed in many embodiments.

Player Database

FIG. 7 is a tabular representation 700 of the player database 210 of FIG. 2. The tabular representation 700 of the player database 210 includes a number of example records or entries each defining a player. Those skilled in the art will understand that the player database 210 may include any number of entries. The tabular representation 700 also defines fields for each of the entries or records. The fields specify: (i) a player identifier 702 that uniquely identifies the player; (ii) a player name 704; (iii) a financial account identifier 706 of the player; which may represent, for example, a credit card account, a debit card account and other financial accounts; (iv) a demographic 708 of the player, which may indicate, for example, the gender, age, residence, income and occupation of the player; (v) machine identifier 710 which indicates which gaming device(s) the player plays or has played; (vi) rate of play 712 that the player has averaged over all plays, or over a portion of his plays; (vii) the total duration 714 which the player has played; (viii) the projected theoretical win 716 of the player, based on, for example, what the player is playing or likely to play in the future; (ix) the historical theoretical win 718 of the player, based on, for example, the number and types of games the player has played; and (x) the casino's actual win-loss ratio for the player.

Not all of the fields depicted in FIG. 7 are required, and various substitutions, deletions and other changes to the tabular representation will be readily apparent to those of ordinary skill in the art.

Offer Database

FIG. 8 is a tabular representation 800 of the offer database 212 of FIG. 2. The tabular representation 800 of the offer database 212 includes a number of example records or entries each defining an offer which may be presented to one or more players. Those skilled in the art will understand that the offer database 212 may include any number of entries. The tabular representation 800 also defines fields for each of the entries or records. The fields specify: (i) an offer identifier 802 that uniquely identifies the offer; (ii) a value 804 if the form of payout is cash; (iii) a value 806 if the form of payout is a merchandise credit at a casino store; (iv) a value 808 if the form of payout is a merchandise credit at a casino spa; (v) a value 810 if the form of payout is a merchandise credit at a casino restaurant; (vi) a value 812 if the form of payout is a merchandise credit at a store AMAZON.COM™; (vii) a value 814 if the form of payout is a merchandise credit at a software store; and (viii) a value 816 if the form of payout is a merchandise credit at a store WALMART™.

Not all of the fields depicted in FIG. 8 are required, and various substitutions, deletions and other changes to the tabular representation will be readily apparent to those of ordinary skill in the art. The depicted fields, for example the various forms of payout, are for illustration only. Various other forms of payout are described herein and still others will be readily apparent to those of skill in the art.

The representation of the values for various forms of payout are depicted in FIG. 8 in terms of a variable 'X', which represents the value if the form of payout is cash. In other words, in the depicted example, the ratio of values for any two forms of payout is a constant for any particular value of any form of payout. Equivalently, in the depicted example, the value in one form of payout is a linear function of the value in another form of payout. It will be readily apparent that there are no restrictions on the other functions that may be employed by the invention, and thus no restrictions on the particular values for various forms of payout.

Many other representations are possible. For example, the offer database 212 may include for each entry one or more dollar amounts (or credit amounts, etc.), each for a forms of payout. The particular forms of payout associated with a first offer may be different from the particular forms of payout associated with a second offer.

Processes

Figure 9:
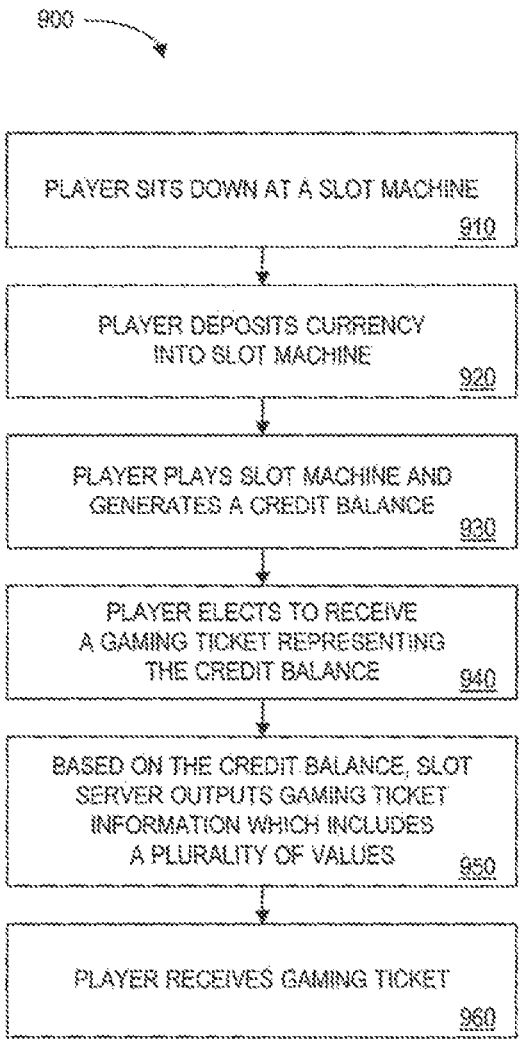
FIG. 9 is a flow chart representing an embodiment of a process that may be performed by a player.

Referring to FIG. 9, a flow chart 900 represents an embodiment of the present invention that may be performed by player of a gaming device, including without limitation a slot machine. The particular arrangement of elements in the flow chart of FIG. 9, as well as the other flow charts discussed herein, is not meant to imply a fixed order to the steps; the steps can be practiced in any order that is practicable in various embodiments of the present invention.

The player sits down at a slot machine (step 910) and deposits currency or other monetary value into the slot machine (step 920). The player then plays the slot machine and generates a credit balance (step 930) in a manner known in the art. When he desires, the player elects to receive a ticket that represents all or a portion of the balance (step 940). Typically, the player does so by pressing a "cashout" button on the gaming device. The gaming device, independently or in cooperation with the server, may determine a plurality of values and corresponding forms of payout, and output this information on a ticket (step 950). Each of the values is usually, but not necessarily, based on the balance. The player then receives the ticket (step 960).

Figure 10:
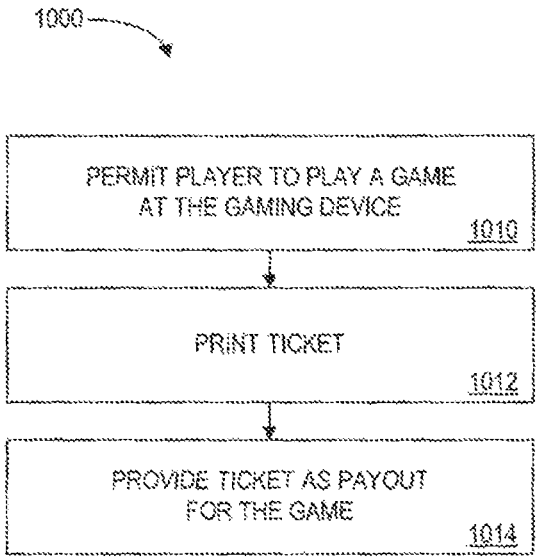
FIG. 10 is a flow chart representing an embodiment of a process that may be performed by a gaming device.

Referring to FIG. 10, a flow chart 1000 represents an embodiment of the present invention that may be performed by a gaming device, including without limitation a slot machine. The particular arrangement of elements in the flow chart of FIG. 10, as well as the other flow charts discussed herein, is not meant to imply a fixed order to the steps; the steps can be practiced in any order that is practicable in various embodiments of the present invention.

The gaming device permits a player to play a game at the gaming device, in a manner well known in the art (step 1010). Using an example of a player playing at a slot machine, the player typically inserts a monetary amount (e.g., coins, bills, tokens, chips, credit card, cashless gaming ticket), indicates a wager amount (e.g., by pressing buttons), and initiates play (e.g., by pulling a handle or pressing a button).

The gaming device prints a ticket that may have various indicia thereon (step 1012). The ticket may be printed in response to a player request to receive some or all of his balance of funds. (e.g., when the player presses a "cashout" button on the gaming device).

In various embodiments the ticket may be printed before the player requests to receive some or all of his balance of funds. In various embodiments, the ticket need not be printed by the gaming device at all. The ticket may instead be printed by another device, which may or may not be in communication with the gaming device.

Figure 11:
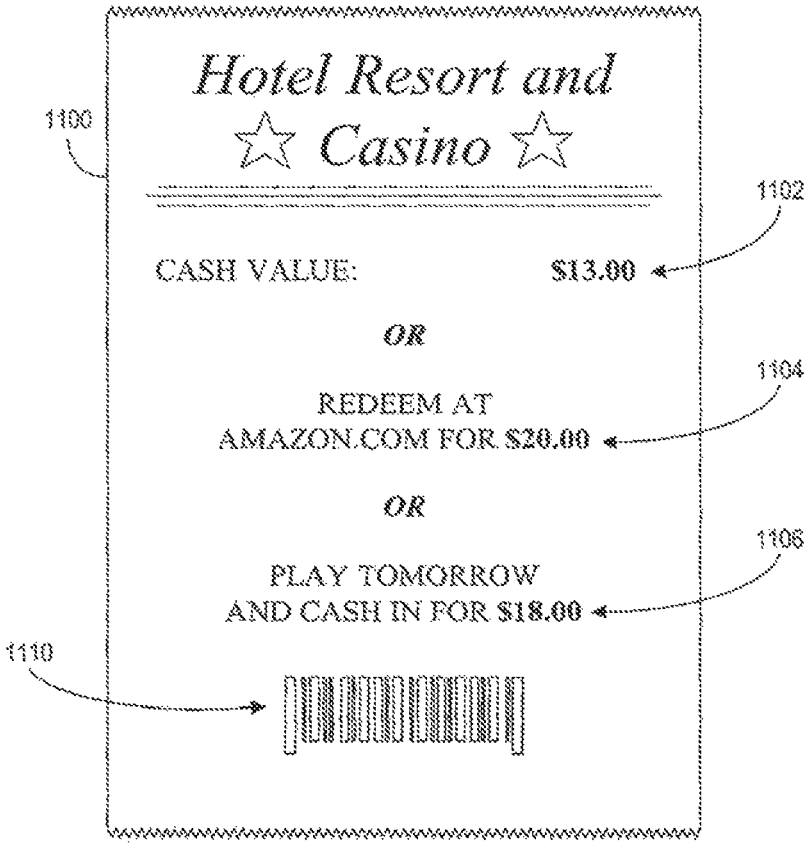
FIG. 11 is a ticket according to one embodiment of the invention.

The gaming device provides the player with the ticket as a payout for the game (step 1014). The gaming device typically ejects or feeds the ticket through a slot or other opening in a manner known in the art, making the ticket available to the player FIG. 11 depicts an illustration of a ticket 1100. The depicted ticket 1100 is merely one example provided in accordance with one embodiment of the invention, and various other types and forms of ticket are within the scope of the invention.

The ticket 1100 includes indicia 1102, 1104 and 1106 that indicate a plurality of values, each with a corresponding form of payout. Any number of such indicia may be included on the ticket. The indicia 1102 indicates a first value ($13) in the form of cash, and the indicia 1104 indicates a second value ($20) in the form of a coupon for a merchant AMAZON-.COM™ The indicia 1106 indicates a third value ($18) for use in a subsequent play of the game (or, e.g., another game at the same casino).

The ticket 1100 also includes indicia 1110 in the form of a bar code. The generation, printing and form of bar codes are well known in the art. The bar code can uniquely represent any information desired, such as the plurality of values and corresponding forms of payout denoted by the ticket. The bar code could additionally or alternatively represent other information, such as a unique player identifier, the time of the payout, and/or an identifier that uniquely identifies the gaming device. Information represented by a bar code need not be visible on the ticket or otherwise discernible to the player or anyone viewing the ticket.

Figure 12:
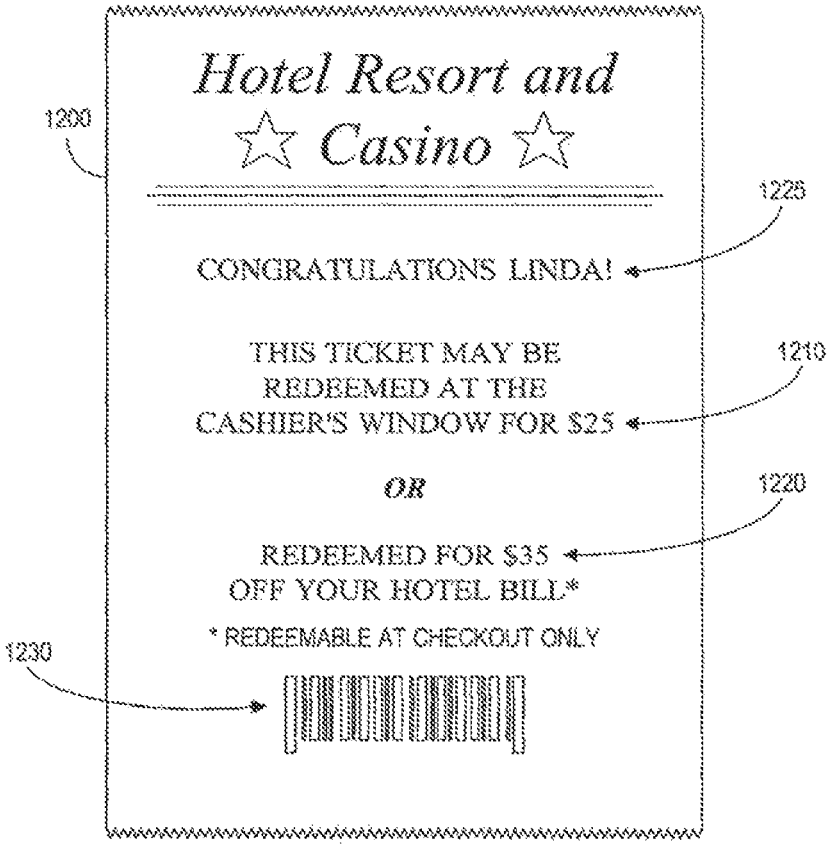
FIG. 12 is another ticket according to one embodiment of the invention.

FIG. 12 depicts an illustration of another ticket 1200. The depicted ticket 1200 is merely one example provided in accordance with one embodiment of the invention, and various other types and forms of ticket are within the scope of the invention.

The ticket 1200 includes indicia 1210 and 1220 that indicate a plurality of values, each with a corresponding a form of payout. Any number of such indicia may be included on the ticket. The indicia 1210 indicates a first value ($25) in the form of cash, and the indicia 1120 indicates a second value ($35) in the form of a credit on a hotel bill. This form of payment includes a restriction that the value can only be acquired at a certain time (i.e. when the player checks out of the hotel). As described herein, many types of restrictions may be applied, and many others will be readily apparent to those of ordinary skill in the art.

The indicia 1225 indicates the name of the player. Players may be identified by the gaming device, typically by the player's use of a player tracking card. This information permits the ticket and the associated payout to be customized to the player, as described herein.

The ticket 1200 also includes indicia 1230 in the form of a bar code. Which may represent, e.g., the plurality of values and corresponding forms of payout denoted by the ticket.

Figure 13:
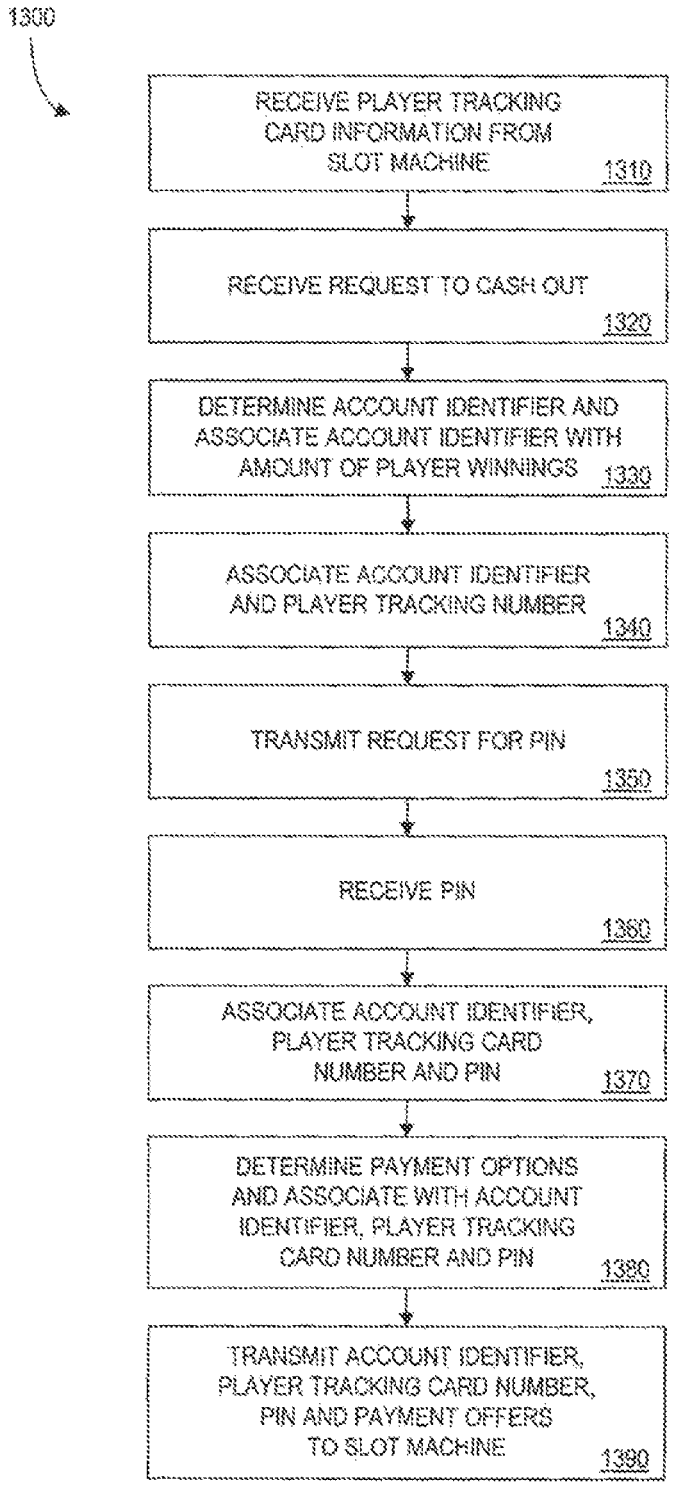
FIG. 13 is a flow chart representing an embodiment of a process that may be performed by a gaming device.

Referring to FIG. 13, a flow chart 1300 represents an embodiment of the present invention that may be performed by a gaming device, including without limitation a slot machine. The particular arrangement of elements in the flow chart of FIG. 13, as well as the other flow charts discussed herein, is not meant to imply a fixed order to the steps; the steps can be practiced in any order that is practicable in various embodiments of the present invention.

The gaming device receives a player tracking card from a player (step 1310) and reads information from the player tracking card in a manner known in the art. Typically, the player tracking card stores a unique player identifier, which is in turn used to access information (e.g., from a record of a database indexed by the player identifier) from the server. The information may be, for example, an entry of the player database.

After one or more plays of the gaming device, the gaming device receives a request to cash out from the player (step 1320). The gaming device records the amount of the player's winnings (e.g., the balance of the gaming device) and associates that amount with the player's account identifier (step 1330). For example, the appropriate entry of the player database may include a field that stores a financial account identifier, indicating a bank account, a credit card account or account with the casino. The financial account may be updated (e.g., an amount of funds transferred to the account in accordance with the player winnings. The appropriate entry of the player database may alternatively or additionally include a field that stores the balance, or updates an amount of aggregate balances the player has won.

Alternatively, the gaming device can record the amount of the player's winnings and associate that amount with a newly created account identifier. Then the account identifier would be associated with the player (step 1340), typically by storing the account identifier in the appropriate entry of the player database, or by otherwise associating the account identifier with the player identifier of the player tracking card.

The gaming device requests a PIN (personal identification number) code from the player (step 1350), typically by displaying appropriate instructions as a textual message and/or an image. The gaming device receives the PIN code (step 1360) entered by the player on, e.g., a touch screen. The gaming device communicates with the server to associate the PIN code with the player (step 1370), typically by storing the PIN code in the appropriate entry of the player database. The PIN code may also constitute the player identifier, and thus may be used to identify the player even if the player does not have or does not use a player tracking card. The server or gaming device then determines payment options (such as values and corresponding forms of payout), and associates those with the player (step 1380), typically by storing data indicating the values and corresponding forms of payout in the appropriate entry of the player database. If the server is responsible for storing the player database and updating the entries as described, the server then transmits the appropriate information to the gaming device (step 1390), which may use some or all of the information for printing on a ticket.

Figure 14:
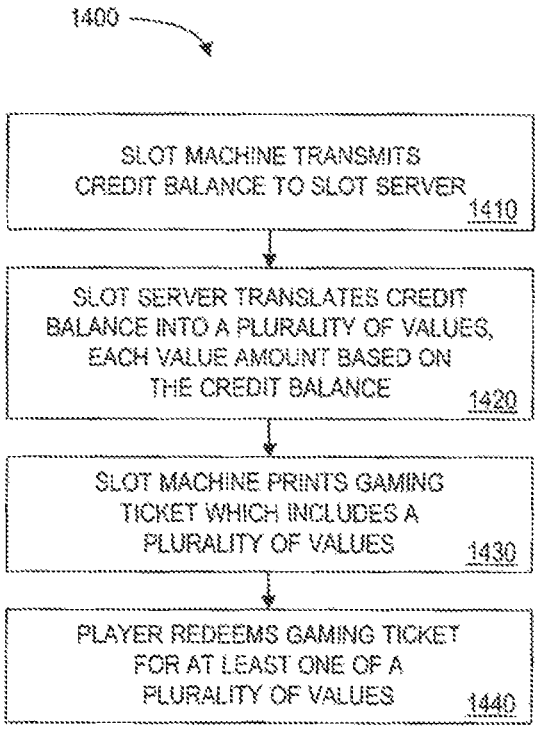
FIG. 14 is a flow chart representing an embodiment of a process according to one embodiment of the invention.

Referring to FIG. 14, a flow chart 1400 represents an embodiment of the present invention that may be performed by a gaming device, including without limitation a slot machine. The particular arrangement of elements in the flow chart of FIG. 14, as well as the other flow charts discussed herein, is not meant to imply a fixed order to the steps; the steps can be practiced in any order that is practicable in various embodiments of the present invention.

The gaming device transmits a balance of the player to the server (step 1410). In one embodiment, upon cash out the server determines a plurality of values and corresponding forms of payout to provide to the player (step 1420). The gaming device may instead perform all of the described functions of the server. The slot server translates the balance into a plurality of values, each corresponding to a form of payout. In one embodiment each value is based on the balance. However, in other embodiments, not all values are based on the balance.

The gaming device prints or otherwise creates a ticket that represents the plurality of values (step 1430). The ticket may be subsequently redeemed by the player for one or more of the plurality of values (step 1440), according to the corresponding forms of payout and any restrictions that may apply to the forms of payment.

Figure 15:
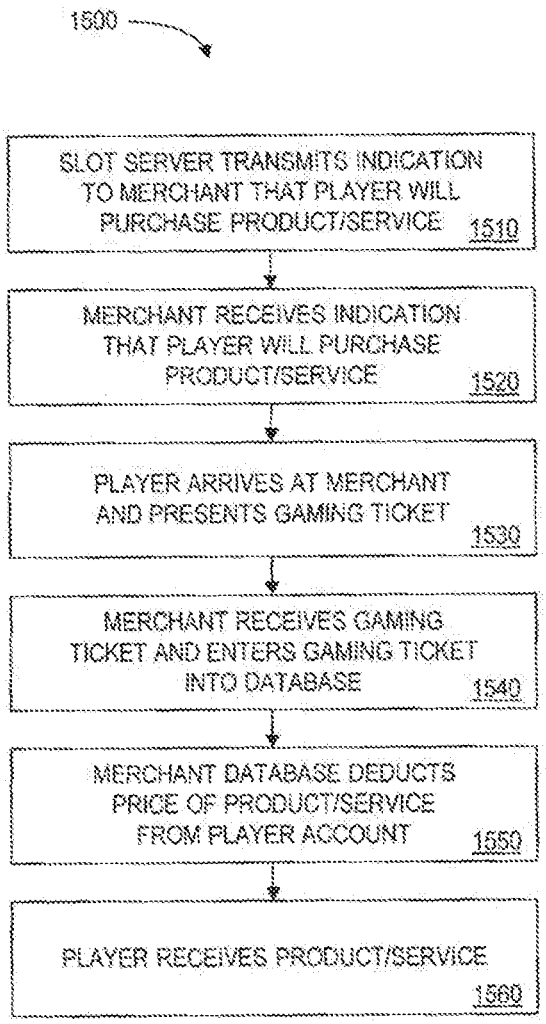
FIG. 15 is a flow chart representing an embodiment of a process that may be performed by a merchant terminal.

Referring to FIG. 15, a flow chart 1500 represents an embodiment of the present invention that may be performed by a merchant terminal. The particular arrangement of elements in the flow chart of FIG. 15, as well as the other flow charts discussed herein, is not meant to imply a fixed order to the steps; the steps can be practiced in any order that is practicable in various embodiments of the present invention.

The merchant terminal receives from the server an indication that a player will purchase a product of the merchant (steps 1510 and 1520). The indication will may be, for example, data representing a bar code and associated value of a merchandise credit with the merchant (e.g., $20 off the purchase price). The player arrives at the merchant and presents a ticket (step 1530). The ticket may include a bar code, which can be easily read by the merchant terminal with a bar code reader in a manner well known in the art. The bar code and/or the data the bar code represents can be stored into a database of the merchant terminal (step 1540) to indicate, e.g., that the player has redeemed the merchandise credit with a purchase.

The merchant terminal deducts the value of the merchandise credit from the price to be paid. The merchant terminal may alternatively reduce the stored value of the player's account (step 1550) by the amount of the purchase, in an embodiment where the player has an account with a balance that may be used for purchases from the merchant. The player has accordingly received the product from the merchant at a discount (step 1560).

Figure 16:
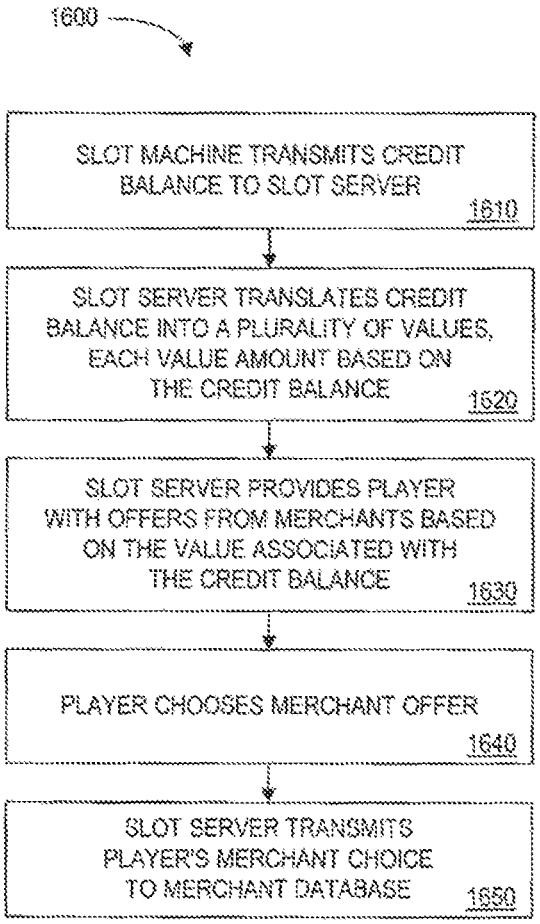
FIG. 16 is a flow chart representing an embodiment of a process that may be performed by a server.

Referring to FIG. 16, a flow chart 1600 represents an embodiment of the present invention that may be performed by the server. The particular arrangement of elements in the flow chart of FIG. 16, as well as the other flow charts discussed herein, is not meant to imply a fixed order to the steps; the steps can be practiced in any order that is practicable in various embodiments of the present invention.

A gaming device, including without limitation a slot machine, transmits to the server the player's balance with the gaming device (step 1610). The server determines a plurality of values and corresponding forms of payout to provide to the player or offer to the player (step 1620). The values may each be based on the balance, but in various embodiments not all of the values are based on the balance. For example, one value and corresponding form of payout may always be a $10 reduction in the player's hotel bill or a $15 credit with a hotel restaurant.

The server provides the player (e.g., via the gaming device) with offers from one or more merchants (step 1630). Each offer corresponds to a value and corresponding form of payout described above. The details of the offers (e.g., values, restrictions on redemption) may be received from the merchants periodically (e.g., every week) or may be received in real time (e.g., when the player requests to cash out).

The player selects one or more of the merchant offers (step 1640), typically by pressing portions of a touch screen overlaid on a monitor that displays buttons on those portions. The gaming device transmits the player selection(s) to the server (step 1650), and the server stores the selected value(s) and form(s) of payout in the entry of the player database that corresponds to the player.

In some embodiments, the payout the player receives may be redeemed for one of a plurality of values, and thus one corresponding form of payout. Typically, one of the forms of payout is cash, which is typically redeemed at a cashier's window in a casino. Other forms of payout include a coupon for a merchant, a merchandise credit such as a credit with a casino shop or a third party, a credit card (which may have a certain credit balance pre-established), a one-time use credit card, a prepaid phone card redeemable for phone time, a credit to play the game (or a different game, or any game in the casino) again, frequent flyer miles, a credit to a bill, a particular product purchase from a merchant, a credit on a hotel bill and a right to purchase a product at a certain price.

Typically, at least two of the plurality of values are different from each other. For example, no two values of a plurality of values may be alike. However in other embodiments two or more values may be equal.

Similarly, in some embodiments at least two of the forms of payout are different from each other. In addition, two forms of payout may be the same but may have different restrictions on redemption or usage. For example, one may be a $20 reduction in the player's hotel bill if redeemed at checkout, while the other is a $10 reduction in the player's hotel bill if redeemed any other time.

Selection of the values and/or forms of payment may be made in a variety of manners. In one embodiment the server determines the values and forms of payout. Such determination may be based on various criteria, such as player characteristics, preferences of merchants, and revenue management requirements of the casino and merchants.

In another embodiment the determination may be made by a human. For example, the player may select (e.g., via touch screen at the gaming device) what merchants where he is interested in redeeming the payout. Similarly, a casino may use a waitress or designated payment offer host to present payout offers to a player. For example, a player may be playing at a blackjack table and indicate to the blackjack dealer that he is planning on ending his play in 10 minutes. The black jack dealer may then send an indication to a central computer or Offer Host that a player may be interested in receiving payout offers. At that point, a waitress or payment offer host may come to the blackjack table and present the player with multiple payment offers. It may be noted that increased value can come from the physical and emotional connection that the waitress or offer host can make with the player. For example, the waitress or offer host may ask the player what kinds of payment offers he would like to receive. In another example, the waitress or offer host may present the player with predetermined payment offers. The waitress or offer host may enter the selected form of payment to the server directly or indirectly.

Additional Embodiments

The following are several examples which illustrate additional embodiments of the present invention. These examples do not constitute a definition of all possible embodiments, and those skilled in the art will understand that the present invention is applicable to many other embodiments. Further, although the following examples are briefly described for clarity, those skilled in the art will understand how to make any changes, if necessary, to the above-described apparatus and methods to accommodate these and other embodiments and applications.

The gaming device may perform some or all of the described functions of the server. Similarly, the server may perform some or all of the described functions of the gaming device.

Payouts need not be made in the form of ticket. For example, the payout can comprise a data signal that represents the payout. Such a data signal could be transmitted to a player's handheld device (e.g., FDA, cell phone) wirelessly (e.g., radio frequency, infrared) or in another manner (e.g., via physical connection between the player device and the gaming device). Such data could represent the information that represent, e.g., a plurality of values and corresponding forms of payout denoted by the payout. The data could represent anything represented by the bar code, as well as additional information. The data may be encrypted to prevent tampering by the player.

Similarly, the payout can comprise a data signal that represents the payout. Such a data signal could be transmitted to the server, where an account could store the players value(s) and forms of payment. The player could redeem the values and the account would be adjusted in accordance with any value redeemed.

In one embodiment, the player may be offered the ability to purchase products (e.g., casino products, third party products) with a portion of his winnings. For example, a player may have a balance of $237 and may round down his winnings to $200 in order to purchase a product for the $37 difference. In other words, the offer can be an offer to reduce a value of the payout in exchange for purchasing a product, where the reduced payout is the payout rounded to a predetermined multiple.

In one embodiment, the player may be offered to increase his payout in exchange for the player agreeing to perform a specified action. For example, a player may have a winning balance of $85. A casino may round the players $85 up to $100 if the player agrees to come back the next day and play for a certain amount of time. In other words, the offer can be an offer to increase the payout by rounding the payout up to a predetermined multiple.

In one embodiment, the form of payout can be that the player receives an increased payout over time (e.g., 10% every day for 10 days).

Although the present invention has been described with respect to a preferred embodiment thereof, those skilled in the art will note that various substitutions may be made to those embodiments described herein without departing from the spirit and scope of the present invention.

The invention is claimed as follows:

1. A gaming system comprising:

a housing;

a plurality of input devices supported by the housing, said plurality of input devices including:

(i) an acceptor, (ii) a validator, and (iii) a cashout device;

at least one display device supported by the housing;

at least one processor; and at least one memory device which stores a plurality of instructions which, when executed by the at least one processor, cause the at least one processor to operate with the plurality of input devices and the at least one display device to:

(a) if a physical item is received via the acceptor:

(i) identify, via the validator, the received physical item, and (ii) establish a credit balance based, at least in part, on a monetary value associated with the received and identified physical item, (b) receive, via at least one of the plurality of input devices, a placement of a wager in association with a play of a game, (c) for the play of the game:

(i) determine, via the at least one processor, a game outcome, (ii) display, via the at least one display device, the determined game outcome, (iii) determine, via the at least one processor, any award associated with the determined game outcome, (iv) display, via the at least one display device, any determined award associated with the determined game outcome, and (v) modify, via the at least one processor, a credit meter balance based on any determined award associated with the determined game outcome, (d) receive an input, via at least one of the plurality of input devices, of a selection of one of a plurality of different forms of payment, and (e) if a cashout input is received, via the cashout device, to cause an initiation of a cashout, provide a cashout amount, said cashout amount at least partially based on the credit meter balance and said cashout amount being provided in the selected form of payment.

2. The gaming system of claim 1, wherein the forms of payment include at least two selected from the group consisting of: a first amount of currency associated with a first period of time, a second, different amount of currency associated with a second, different point of time, a play of a second game, a coupon redeemable for a credit on a product, and a coupon redeemable for a credit on a service.

3. The gaming system of claim 2, wherein at least one of: the wager placed in association with the play of the game, the first amount of currency and the second amount of currency includes at least one selected from the group consisting of: a quantity of monetary credits and a quantity of non-monetary credits.

4. The gaming system of claim 1, wherein when executed by the at least one processor, the plurality of instructions cause the at least one processor to:

provide a first cashout amount if a first one of the forms of payment is selected, and provide a second, different cashout amount if a second, different one of the forms of payment is selected.

5. The gaming system of claim 1, wherein when executed by the at least one processor, the plurality of instructions cause the at least one processor to receive the selection of one of the plurality of different forms of payment if the cashout input is received.

6. A method of operating a gaming system, said method comprising:

(a) receiving a placement of a wager in association with a play of a game, (b) for the play of the game:

(i) causing at least one processor to execute a plurality of instructions to determine a game outcome, (ii) causing at least one display device to display the determined game outcome, (iii) causing the at least one processor to execute the plurality of instructions to determine any award associated with the determined game outcome, (iv) causing the at least one display device to display any determined award associated with the determined game outcome, and (v) causing the at least one processor to execute the plurality of instructions to modify a credit meter balance based on any determined award associated with the determined game outcome, said credit meter balance being:

(A) increasable via:

(I) an acceptor of a physical item associated with a monetary value, and (II) a validator configured to identify the physical item, and (B) decreasable via a cashout device, (c) receiving an input of a selection of one of a plurality of different forms of payment, and (d) if a cashout input is received, via the cashout device, to cause an initiation of a cashout, providing a cashout amount, said cashout amount at least partially based on the credit meter balance and said cashout amount being provided in the selected form of payment.

7. The method of claim 6, wherein the forms of payment include at least two selected from the group consisting of: a first amount of currency associated with a first period of time, a second, different amount of currency associated with a second, different point of time, a play of a second game, a coupon redeemable for a credit on a product, and a coupon redeemable for a credit on a service.

8. The method of claim 7, wherein at least one of: the wager placed in association with the play of the game, the first amount of currency and the second amount of currency includes at least one selected from the group consisting of: a quantity of monetary credits and a quantity of non-monetary credits.

9. The method of claim 6, which includes:

providing a first cashout amount if a first one of the forms of payment is selected, and providing a second, different cashout amount if a second, different one of the forms of payment is selected.

10. The method of claim 6, which includes receiving the selection of one of the plurality of different forms of payment if the cashout input is received.

11. The method of claim 6, which is operated through a data network.

12. The method of claim 11, wherein the data network is an internet.

13. A gaming system server comprising:

at least one processor; and at least one memory device which stores a plurality of instructions which, when executed by the at least one processor, cause the at least one processor to:

(a) receive first data corresponding to a placement of a wager in association with a play of a game, (b) for the play of the game:

(i) determine a game outcome, (ii) cause at least one display device to display the determined game outcome, (iii) determine any award associated with the determined game outcome, (iv) cause the at least one display device to display any determined award associated with the determined game outcome, and (v) modify a credit meter balance based on any determined award associated with the determined game outcome, said credit meter balance being:

(A) increasable via:

(I) an acceptor of a physical item associated with a monetary value, and (II) a validator configured to identify the physical item, and (B) decreasable via a cashout device, (c) receive second data corresponding to a selection of one of a plurality of different forms of payment, and (d) if a cashout request occurs, cause at least one output device to provide a cashout amount, said cashout amount at least partially based on the credit meter balance and said cashout amount being provided in the selected form of payment.

14. The gaming system server of claim 13, wherein the forms of payment include at least two selected from the group consisting of: a first amount of currency associated with a first period of time, a second, different amount of currency associated with a second, different point of time, a play of a second game, a coupon redeemable for a credit on a product, and a coupon redeemable for a credit on a service.

15. The gaming system server of claim 14, wherein at least one of: the wager placed in association with the play of the game, the first amount of currency and the second amount of currency includes at least one selected from the group consisting of: a quantity of monetary credits and a quantity of non-monetary credits.

16. The gaming system server of claim 13, wherein when executed by the at least one processor, the plurality of instructions cause the at least one processor to:

cause the at least one output device to provide a first cashout amount if a first one of the forms of payment is selected, and cause the at least one output device to provide a second, different cashout amount if a second, different one of the forms of payment is selected.

17. The gaming system server of claim 13, wherein when executed by the at least one processor, the plurality of instructions cause the at least one processor to receive second data corresponding to the selection of one of the plurality of different forms of payment if the cashout request occurs.

* * * * *